US008289146B2

(12) United States Patent
Barrieau et al.

(10) Patent No.: US 8,289,146 B2
(45) Date of Patent: Oct. 16, 2012

(54) SYSTEM FOR TESTING NAC OPERABILITY USING REDUCED OPERATING VOLTAGE

(75) Inventors: Johnpaul P. Barrieau, Gardner, MA (US); Gary Vincent, Lunenburg, MA (US); Mark P. Barrieau, Baldwinville, MA (US)

(73) Assignee: SimplexGrinnell LP, Westminster, MA (US)

( * ) Notice: Subject to any disclaimer, the term of this patent is extended or adjusted under 35 U.S.C. 154(b) by 0 days.

(21) Appl. No.: 13/275,946

(22) Filed: Oct. 18, 2011

(65) Prior Publication Data

US 2012/0032794 A1 Feb. 9, 2012

Related U.S. Application Data

(63) Continuation-in-part of application No. 11/282,358, filed on Nov. 18, 2005, now Pat. No. 7,333,010, and a continuation-in-part of application No. 11/825,213, filed on Jul. 5, 2007, and a continuation of application No. 12/277,790, filed on Nov. 25, 2008, now Pat. No. 8,063,763.

(51) Int. Cl.
*G08B 29/00* (2006.01)

(52) U.S. Cl. .... 340/514; 340/506; 340/508; 340/286.05

(58) Field of Classification Search ..... 340/514, 340/540, 636.12, 635, 660, 507, 57, 538, 340/533, 535

See application file for complete search history.

(56) References Cited

U.S. PATENT DOCUMENTS

| | | | | |
|---|---|---|---|---|
| 3,641,570 | A | 2/1972 | Thompson | |
| 3,665,461 | A | 5/1972 | Gnagi et al. | |
| 4,274,087 | A | 6/1981 | Swanson et al. | |
| 4,470,047 | A | 9/1984 | Vogt et al. | |
| 4,777,473 | A | 10/1988 | Weston et al. | |
| 5,705,979 | A | 1/1998 | Fierro et al. | |
| 5,754,103 | A | 5/1998 | Kanai et al. | |
| 6,034,601 | A | 3/2000 | Barrieau et al. | |
| 6,040,769 | A | 3/2000 | Payne | |
| 6,104,286 | A | 8/2000 | Luquette | |
| 6,281,789 | B1 | 8/2001 | Furtado et al. | |
| 6,313,744 | B1 * | 11/2001 | Capowski et al. | 340/514 |
| 6,426,697 | B1 | 7/2002 | Capowski et al. | |
| 6,502,044 | B1 | 12/2002 | Lane et al. | |

(Continued)

OTHER PUBLICATIONS

Office Action dated Oct. 15, 2010 from corresponding U.S. Appl. No. 12/277,790 (10 pgs).

(Continued)

*Primary Examiner* — Hoi Lau
(74) *Attorney, Agent, or Firm* — Brinks Hofer Gilson & Lione

(57) ABSTRACT

A monitoring system for a NAC (Notification Appliance Circuit) is provided. The monitoring system includes a system controller, and a NAC comprised of one or more notification appliances that may be in a series. The NAC and its appliances may be operatively coupled to the system controller. The system controller is operable to determine whether a notification appliance has sufficient voltage at a low voltage operation. The system controller may control the voltage to the NAC in order to provide power to simulate operation of the NAC using battery power. A voltage may be measured during the simulation (such as at one end of the NAC). The measured voltage may be compared with a predetermined minimum operating voltage for the notification appliance. Based on the comparison, it may be determined whether the one or more appliances on the NAC may operate properly when the NAC is operated using battery power.

18 Claims, 8 Drawing Sheets

U.S. PATENT DOCUMENTS

| | | | | |
|---|---|---|---|---|
| 6,567,001 | B1 * | 5/2003 | Barrieau et al. | 340/506 |
| 6,693,532 | B2 | 2/2004 | Capowski et al. | |
| 7,091,847 | B2 | 8/2006 | Capowski et al. | |
| 7,333,010 | B2 | 2/2008 | Barrieau et al. | |
| 7,382,245 | B2 | 6/2008 | Girouard | |
| 7,469,204 | B2 | 12/2008 | Brooks et al. | |
| 2001/0038336 | A1 | 11/2001 | Acevedo | |
| 2003/0080865 | A1 | 5/2003 | Capowski et al. | |
| 2004/0140891 | A1 | 7/2004 | Capowski et al. | |
| 2005/0139682 | A1 | 6/2005 | Iasso et al. | |
| 2006/0214811 | A1 * | 9/2006 | Barrieau et al. | 340/635 |
| 2007/0001819 | A1 | 1/2007 | Becker et al. | |
| 2007/0115111 | A1 * | 5/2007 | Girouard | 340/507 |
| 2007/0179722 | A1 * | 8/2007 | Brooks et al. | 702/60 |
| 2007/0188427 | A1 | 8/2007 | Lys et al. | |
| 2007/0220907 | A1 | 9/2007 | Ehlers | |
| 2008/0266076 | A1 | 10/2008 | Barrieau et al. | |
| 2008/0272654 | A1 | 11/2008 | Lontka | |
| 2009/0009352 | A1 * | 1/2009 | Savage et al. | 340/663 |
| 2009/0167544 | A1 * | 7/2009 | Becker et al. | 340/636.12 |
| 2009/0322526 | A1 | 12/2009 | Lontka | |
| 2010/0066552 | A1 | 3/2010 | Salgueiro et al. | |
| 2010/0066557 | A1 | 3/2010 | Henson et al. | |
| 2010/0073175 | A1 * | 3/2010 | Lontka | 340/635 |
| 2010/0127849 | A1 | 5/2010 | Barrieau et al. | |

OTHER PUBLICATIONS

Office Action dated Apr. 27, 2011 from corresponding U.S. Appl. No. 12/277,790 (18 pgs).

* cited by examiner

SYSTEM FOR TESTING NAC OPERABILITY USING REDUCED OPERATING VOLTAGE

REFERENCE TO RELATED APPLICATION

This application is a continuation in part of U.S. application Ser. No. 11/282,358 filed Nov. 18, 2005 (now U.S. Pat. No. 7,333,010), is a continuation in part of U.S. application Ser. No. 11/825,213, filed Jul. 05, 2007, and is a continuation of U.S. application Ser. No. 12/277,790 (filed on Nov. 25, 2008 now U.S. Pat. No. 8,063,763, and published as U.S. application Ser. No. 2010-0127849A1). U.S. application Ser. No. 12/277,790 (filed on Nov. 25, 2008 and published as U.S. application Ser. No. 2010-0127849A1) is incorporated herein by reference in its entirety.

BACKGROUND

A fire alarm system typically includes one or more notification appliances that notify the public of an alarm. A Notification Appliance Circuit (NAC) powers the notification appliances that are connected to a fire alarm control panel. A primary power source (such as line power from an AC line) may supply power to the fire alarm control panel. The fire alarm system may also include a backup voltage source that supplies power to the fire alarm control panel. The backup voltage source (such as a battery) is used when the primary power source is unavailable. Abnormal conditions may cause either the primary or backup power supply to operate at a voltage less than nominal. The lowest voltage that will power the NAC is defined as the worst case operating voltage. The NAC may provide power from the control panel to the notification appliances. The notification appliances draw a significant amount of current from the NAC and create a voltage drop across the wires. The voltage drop may reduce the voltage supplied to the notification appliances at the end of the NAC (opposite the control panel) to a level that is below the voltage necessary to power the notification appliance.

Notification Appliances have a specified operating range. During the design of the fire alarm system, a designer estimates whether all the notification appliances will be powered above their specified minimum operating voltage at the worst case operating voltage. To make this estimation, the designer predicts the voltage drop from the fire alarm panel to the last notification device. The voltage drop calculation is based on the electrical characteristics of the NAC as it is configured in the specific installation. The designer then subtracts the predicted voltage drop from the worst case output voltage of the fire alarm panel and compares the result to the minimum operating voltage of the notification appliance. The NAC design is acceptable when the calculated voltage is above the minimum operating voltage of the notification appliance.

However, the installed system may differ from the designed system. For example, the wiring distance of the NAC may differ due to practical considerations in the building, or alternate routings of the wires by the electrical installers. The actual voltage drop on a NAC in the installed system is frequently different than the calculated voltage drop. Therefore, it is important to confirm, after installation, that the NAC has sufficient voltage to operate the notification appliances.

Conventionally, it was difficult to test the voltage drop in an installed system. It was even more difficult to test the voltage drop at or near the lowest suitable voltage on the NAC. The lowest suitable voltage on the NAC is typically the voltage supplied from the control panel when the backup power source, for example, one or more batteries, are at the end of their rated life. The NAC voltage drop is difficult to determine at the lowest suitable voltage because the nominal output voltage of the control panel is significantly higher than the worst case operating voltage.

Notification appliances draw more current at low voltage than they do at higher voltages. If less current is drawn from the NAC, then the voltage drop across the NAC will also be reduced. Measuring the voltage at the control panel and then at the last notification appliance during higher voltage operation (supplied by the primary power source or the backup power source at the beginning of its rated life), will not give an accurate measurement of the voltage drop in the system during the lowest voltage operation (i.e. when the battery is at the end of its rated life).

In a system where the lowest voltage condition occurs when the batteries are nearly discharged, the only way to measure the voltage drop on a NAC during the lowest voltage operation and verify that it is within its designed parameters, is to power the system from batteries for an extended period of time, until the batteries are near their rated end of life and then activate the notification appliances and measure the voltage drop on each NAC. This is generally not practical and is often not done because it is time consuming and potentially damaging to the batteries. In a system where the lowest voltage occurs when the AC power supply is operating under abnormal conditions (for example a fault on the AC line lowers the system voltage), it is difficult to create the abnormal condition. It requires powering the panel from expensive equipment to vary the AC input. This equipment may be practical in a lab environment but very impractical for a field technician to carry. Accordingly, a need exists for testing whether the NAC is capable of operating at a reduced or worst case system voltage that is simple in design and operation.

SUMMARY

The present embodiments relate to a diagnostic monitoring system that determines whether a NAC installation is capable of operating at a reduced, nominal, or worst case system voltage. In order to accomplish this, the diagnostic monitoring system may comprise three parts: (1) a device to control the voltage supplied to the NAC; (2) a remote measurement device to measure the voltage of the NAC (such as an end-of-line device); and (3) a communications system between the Fire Alarm and measurement device. The device to control the voltage supplied to the NAC may create the reduced, nominal, or worst case system voltage. For example, in a test mode, the device to control the voltage supplied to the NAC may control the voltage supplied to the NAC to a test amount. For example, the NAC may be supplied a reduced, nominal, or worst case voltage that may simulate if the NAC were powered at least partly by a battery (such as fully powered by a battery) or powered by a faulty AC line. Specifically, the device may output a voltage that is lower than the voltage supplied under nominal conditions (such as outputting a voltage of 19.5 V in a system that is nominally 24V). As another example, the NAC may be supplied an increased voltage that may simulate if the NAC were powered by a higher voltage than the nominal voltage. In this way, the system may create the presence of abnormal power supply conditions by powering the NAC at the worst case operating voltage (such a worst case lower or upper voltage). This includes simulating using a run-down battery to power the NAC without requiring the running-down of the battery or simulating a faulty AC line without requiring expensive equipment to vary the AC line voltage. Thus, the system may be tested for low-power or high-power conditions without creating a power supply fault.

A fire alarm system may include one or more notification appliances connected in a series across a NAC. The first device to control the power to the NAC (the NAC voltage controller) may be disposed on one end of the NAC. The second device to measure the voltage of the NAC (the NAC voltage measurement device) may be disposed on the other end of the NAC. The NAC voltage controller and NAC voltage measurement device may be in communication with a system controller.

The NAC voltage controller and the NAC voltage measurement device may be used to determine whether the NAC may be operated using a minimum voltage (such as using a backup battery). Specifically, the NAC voltage controller may control the voltage output to the NAC, and the NAC voltage measurement device may measure the voltage at the end-of-the-line. Based on the voltage as measured by the NAC voltage measurement device, it may be determined whether the NAC may be operated properly. Specifically, a monitoring system (such as a fire alarm panel) may receive the voltage as measured by the NAC voltage measurement device, and determine if the NAC may be powered using minimum operating voltage (such as using battery backup). If the measured voltage is less than the minimum NAC appliance voltage, the NAC will have insufficient voltage to maintain functionality of the Notification appliances during low voltage operation. Likewise, if the measured voltage is greater than or equal to the minimum Notification appliance voltage, the NAC will have sufficient voltage to maintain functionality of the notification appliances.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

DETAILED DESCRIPTION

Figure 1:
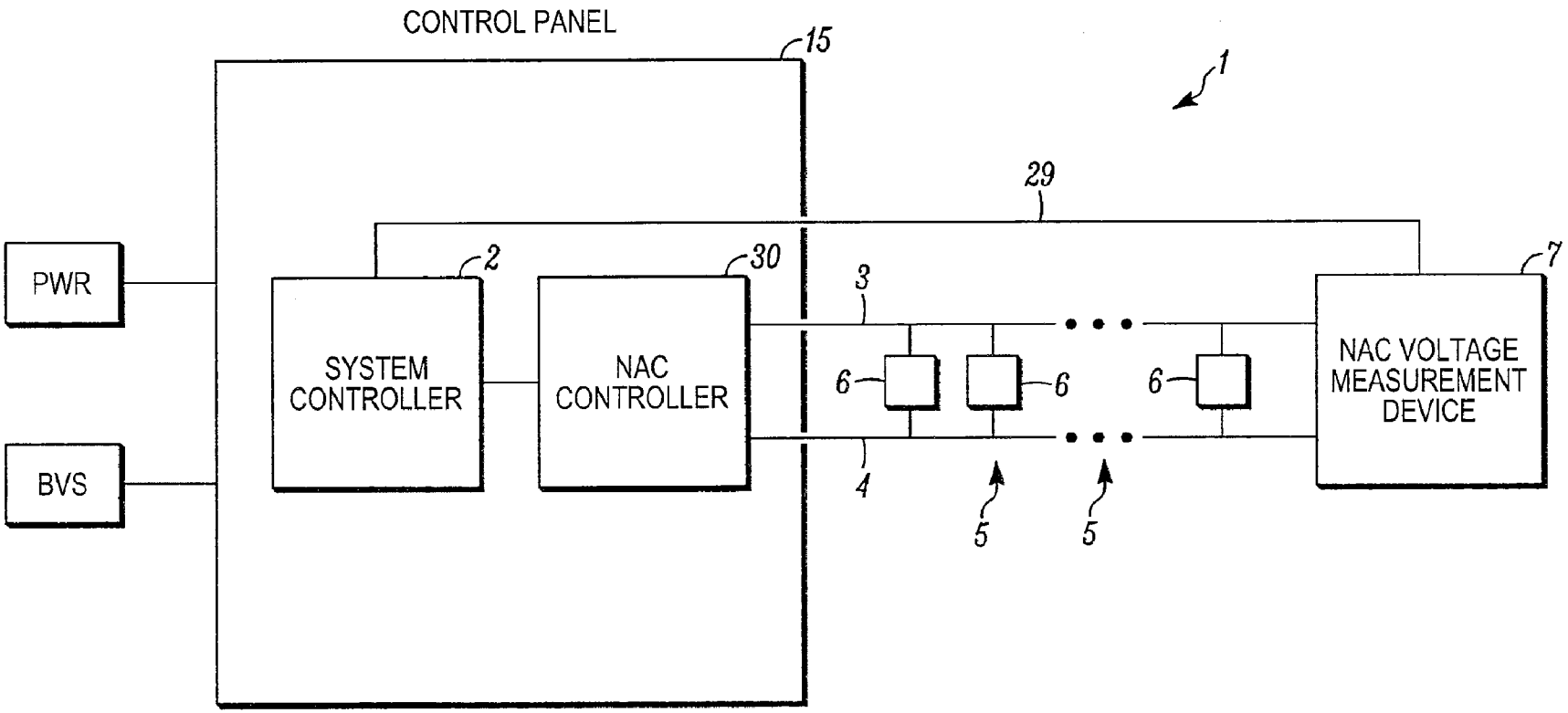
FIG. 1 illustrates one embodiment of a NAC diagnostic system.

FIG. 1 shows one example of a monitoring system 1. The monitoring system 1 may comprise a fire alarm system, a security system, an elevator system, an HVAC system, or the like. The monitoring system 1 includes a NAC 5 comprising one or more notification appliances 6. The notification appliances 6 are controlled by a NAC controller 30. In one example, the notification appliances 6 are not individually addressable, and receive a command to activate all of the notification appliances at once. As another example, the notification appliances 6 may be individually addressable and may be activated individually so that one, some, or all of the notification appliances are activated.

The monitoring system 1 may include a control panel 15 that includes a system controller 2 and the NAC controller 30. The system controller 2 may communicate with the NAC controller 2 in order to activate one or more of the notification appliances 6 in the NAC 5.

Figure 2:
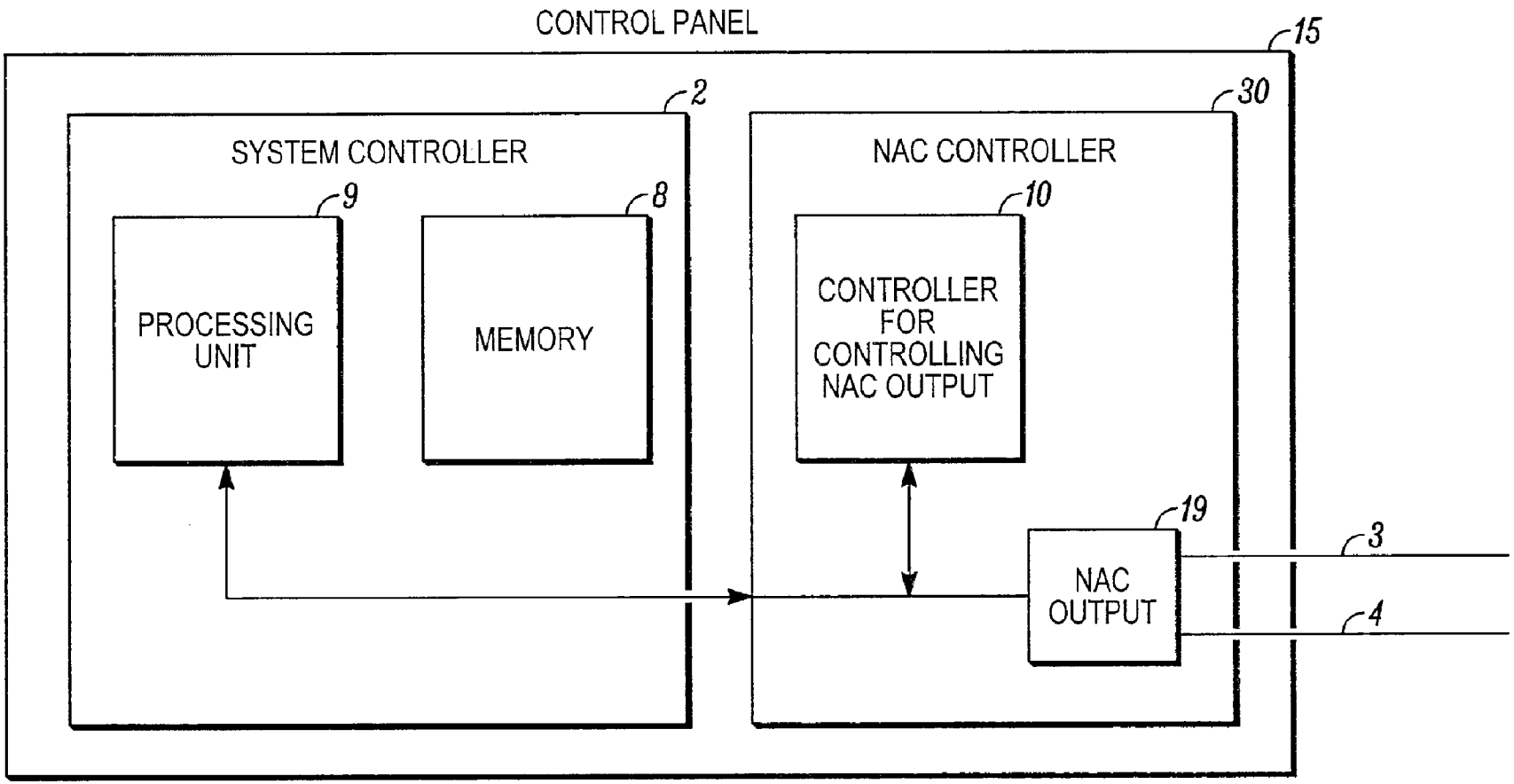
FIG. 2 illustrates one embodiment of a system controller in communication with a NAC controller.

As discussed in more detail in FIG. 2, the system controller 2 includes a processing unit 9 and a memory 8. The NAC controller 30 includes a NAC output controller 10, and NAC output 19 (including NAC output terminals 3 and 4).

The monitoring system 1 may further include a primary power supply PWR that supplies power to the monitoring system 1. FIG. 1 depicts that the primary power supply PWR is input to the control panel 15. The primary power supply PWR may be input to any part of the monitoring system 1. The primary power supply PWR may supply AC or DC power. For example, the primary power supply PWR may include an AC power source ranging from, for example, 100Vac to 240Vac; more preferably 120Vac. The primary power supply PWR may include an AC/DC converter that converts a supplied AC power to DC power. The converted power may be supplied to the system controller 2. The control panel 15 may include an AC/DC converter, DC/DC converter, or a combination thereof.

A backup voltage source BVS may supply power to the monitoring system 1. FIG. 1 depicts that the backup voltage source BVS is input to the control panel 15. The backup voltage source BVS may be input to any part of the monitoring system 1. The backup voltage source BVS may comprise a battery, a generator, or any suitable voltage source. In the event that the power supply PWR is unavailable, unable to sufficiently supply a voltage, or unreliable, the backup voltage source BVS may supply a sufficient voltage to the monitoring system 1. The backup voltage source BVS may supply a voltage to the monitoring system 1 independent of the power supply PWR (a complete switch from PWR to BVS). Alternatively, the backup voltage source BVS may supplement the voltage supplied from the power supply PWR.

The control panel 15 may operate using the power supplied from the primary power supply PWR or the backup voltage source BVS. As discussed above, the primary power supply PWR and the backup voltage source BVS may supply power to the notification appliances 6 via the NAC 5. The system controller 2 or the NAC controller 30 may draw current from the power supplied and create a voltage drop before the power is supplied to the NAC 5. For example, the voltage supplied to the NAC 5 may be less than the voltage supplied to the system controller 2.

As discussed in more detail below, the monitoring system 1 may operate in a normal operational mode and in a test mode. When in the test mode (which may be initiated by operator input to the monitoring system 1), the monitoring system 1 may produce or create an operating voltage (such as a lower or minimum voltage or an upper or maximum voltage) for the NAC using the NAC output controller 10. The lower or minimum operating voltage may be used for systems where low battery operation is the worst case (or lowest) system voltage, so that the production of the lower or minimum operating voltage may simulate that the batteries are being depleted. Or, the lower or minimum operating voltage may be used for systems where the AC power is faulty, so that production of the lower or minimum operating voltage may simulate the fault on the AC power line. The fault on the AC power line may result in a lower AC voltage being input. The upper or maximum voltage may likewise simulate a fault in the system. One configuration of the control panel 15 may include a voltage regulator that outputs a regulated voltage. When there is a fault on the AC power line, the voltage regulator may output a reduced regulated voltage, such as the nominal voltage, or may output an upper voltage. The measurement of the voltage of the end-of-line for the NAC may then be measured using NAC voltage measurement device 7.

As shown in FIG. 2, upon entering the test mode, the system controller 2 may send a command to the NAC Controller 30 in order to activate testing. The command may indicate testing at a lower voltage. Responsive to the command, the NAC controller 30 may access a memory that stores a value indicative of the reduced voltage (such as 19.5V) and may then send a command (along with the value of the reduced voltage) to NAC output controller 10 in order to modify the voltage at terminals 3 and 4 of NAC output 19 to the value of the reduced voltage. The reduced voltage may be the nominal voltage or a voltage lower than the nominal voltage. Since the value of the reduced voltage is programmable by storing the value in the memory accessible by the NAC controller 30, any of a number of values of the reduced voltage may be tested. Alternatively, the system controller 2 may access memory 8 for the value indicative of the reduced voltage, and send a command (along with the value of the reduced voltage stored in memory 8) directly to the NAC output controller 10. Responsive to the command, the NAC output controller 10 may control the voltage to the value of the reduced voltage at terminals 3 and 4 in a variety of ways. As one example, the NAC output controller 10 may control the voltage at terminals 3 and 4 by reducing the voltage to a predetermined voltage (such as 19.5V). The reduction in the voltage to the predetermined voltage may be immediate (from the current voltage to 19.5V, for example). Or, the reduction in the voltage to the predetermined voltage may be gradual.

Though FIG. 2 depicts the NAC output controller 10 as a part of the NAC controller 30, the NAC output controller 10 may be disposed as part of the system controller 2 or as individual elements outside the NAC controller 30. For example, the NAC output controller 10 may be disposed outside of the NAC controller 30.

The notification appliances 6 may be constant power consumption devices. When an alarm condition is sensed by a detection device, the system controller 2 may signal the alarm to the notification appliances 6 through the NAC 5. Notification appliances may include, for example, a visual alarm (strobe), an audible alarm (horn), a speaker, or a combination thereof. Though only one NAC 5 is shown in FIG. 1, additional NACs may be connected to the system controller 2.

As discussed above, the monitoring system 1 may also include a NAC voltage measurement device 7. One or more NAC voltage measurement devices 7 may be coupled to the NAC 5. As shown in FIG. 1, the NAC voltage measurement device 7 is disposed at one end of the NAC 5, with the NAC controller 30 at the other end, and the notification appliances 6 disposed in between. In this way, the NAC voltage measurement device 7 is connected to NAC 5 after the NAC appliance 6 located furthest from the NAC controller 30. Alternatively, the NAC voltage measurement device 7 may be connected to the NAC 5 after any of the notification appliances 6.

Figure 3:
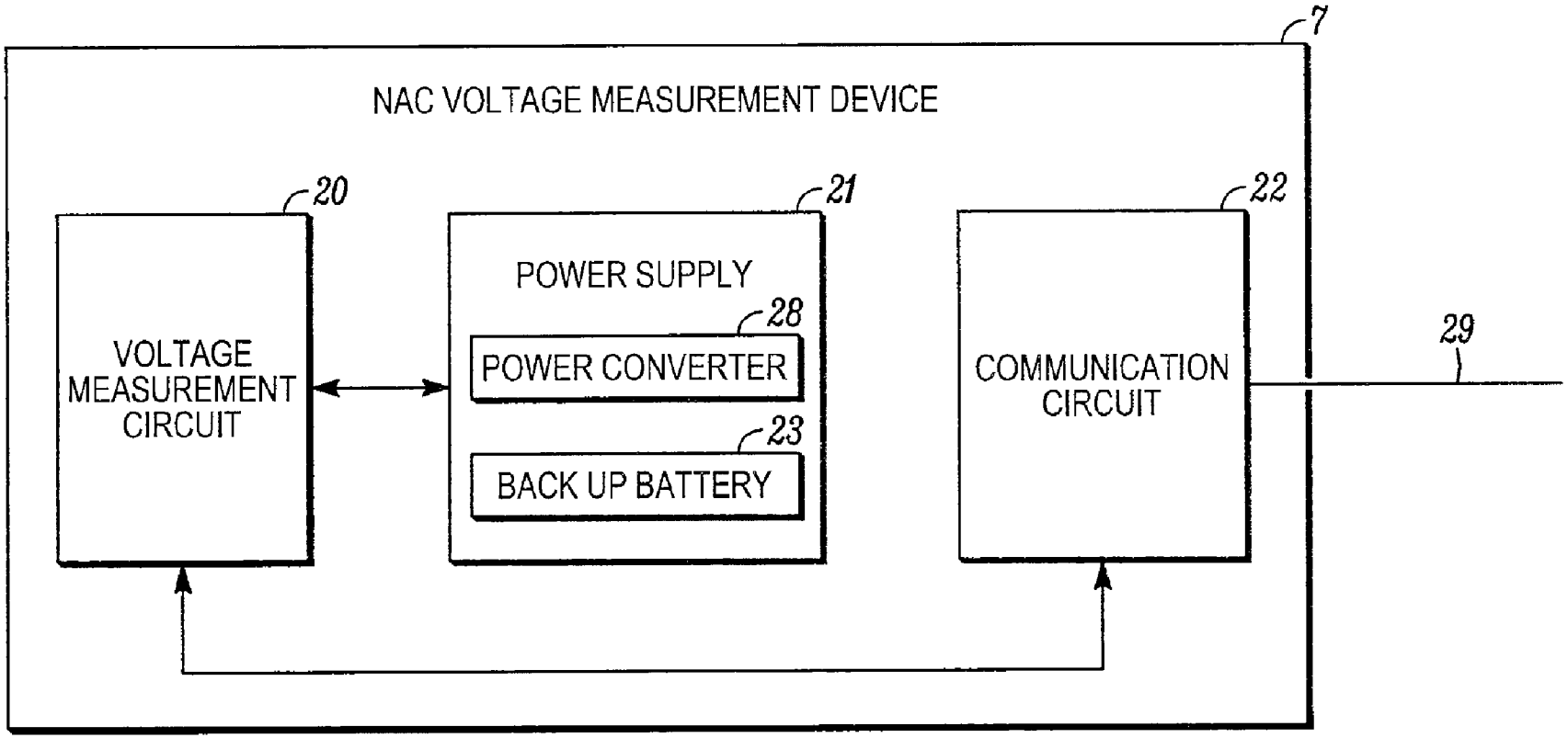
FIG. 3 illustrates one embodiment of a NAC voltage measurement device.

FIG. 3 is a block diagram of the NAC voltage measurement device 7 depicted in FIG. 1. As shown in FIG. 3, the NAC voltage measurement device 7 may include a general purpose voltage measurement circuit 20, a power supply 21, and a communication circuit 22. In one embodiment, the power supply PWR may supply a suitable voltage to the NAC voltage measurement device. As shown in FIG. 3, the power supply 21 may include a backup battery 23 that supplies a backup voltage to the NAC voltage measurement device 7, such as when the power supply PWR from the system controller 2 is unavailable. Alternatively, the power supply 21 may be coupled to a second power supply. The power supply 21 may include a power converter 28 that converts the input voltage to a suitable voltage that operates the circuitry of the voltage measurement circuit 20 and communication circuit 22.

The voltage measurement circuit 20 may measure a voltage on any portion of the NAC 5. For example, the voltage measurement circuit 20 may measure a voltage on the wires 3 and 4 across any of the notification appliances 6. As shown in FIG. 1, the voltage measurement circuit 20 measures a voltage on the wires 3 and 4 of the NAC appliance 6 located closest to the NAC voltage measurement device 7. As discussed in more detail below, the voltage measurement circuit 20 determines a voltage value $V_{NAC}$ based on the voltage value after any NAC appliance 6, such as the last NAC appliance in the series of notification appliances. The voltage measurement circuit 20 may include, for example, an analog-to-digital (A/D) circuit, an op-amp circuit, and a buffering circuit.

The NAC appliance voltage value $V_{NAC}$ may be transferred to the communication circuit 22, which in turn outputs the voltage value $V_{NAC}$ to the transfer line 29. The system controller 2 may receive the voltage value $V_{NAC}$ from the transfer line 29. The processing unit 9 may process various inputs from the voltage measurement device 10, system memory 8, and voltage and current measurement devices 10, 11 to determine whether there is sufficient voltage for the plurality of notification appliances 6. Though in FIG. 1 the processing unit 9 is depicted inside the system controller 2, the processing may be performed remotely from the system controller 2.

Figure 4A:
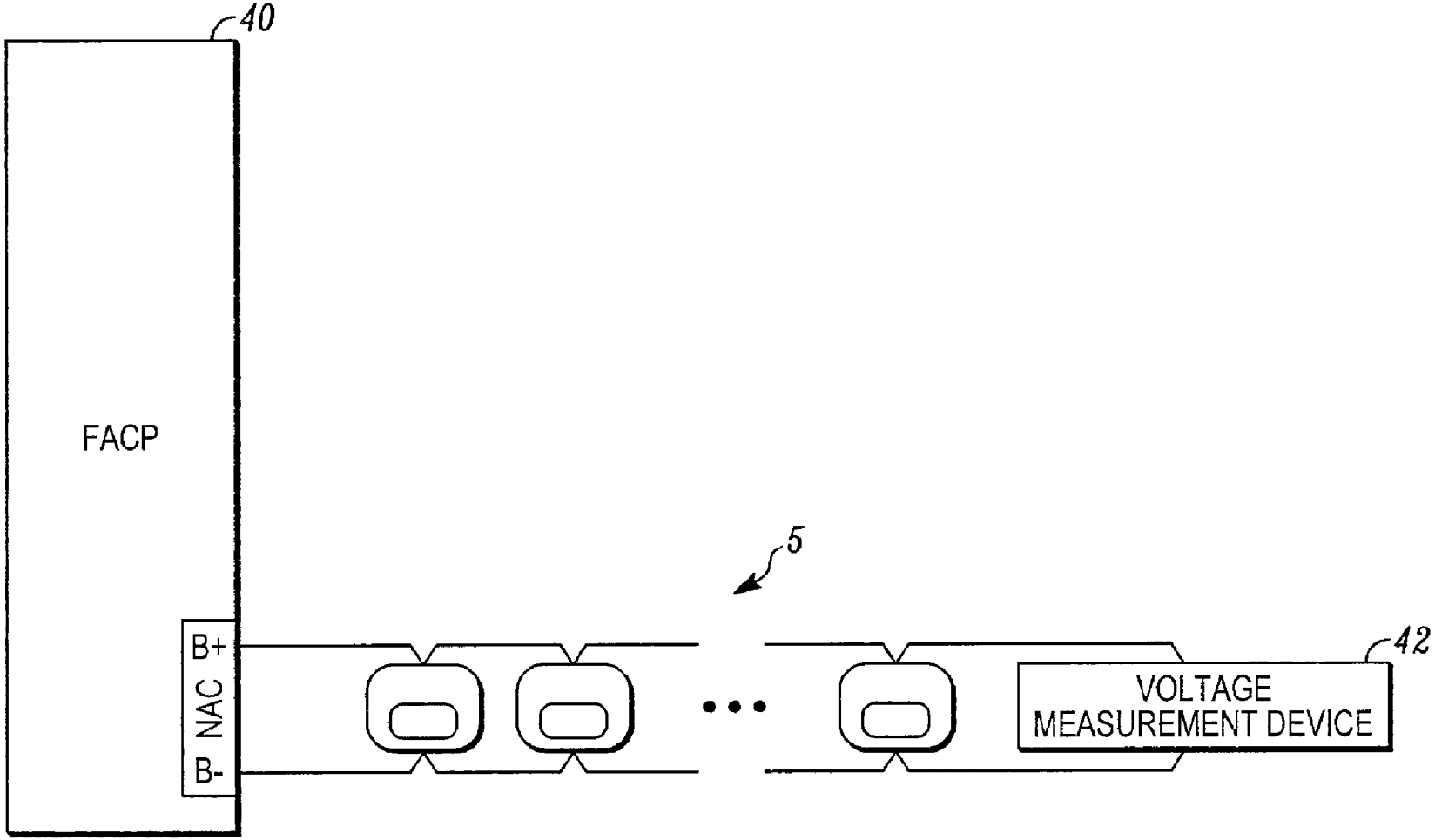
FIGS. 4A-C illustrate different configurations using different classes of wiring of the fire alarm control panel, NACs, and the NAC voltage measurement device.
Figure 4B:
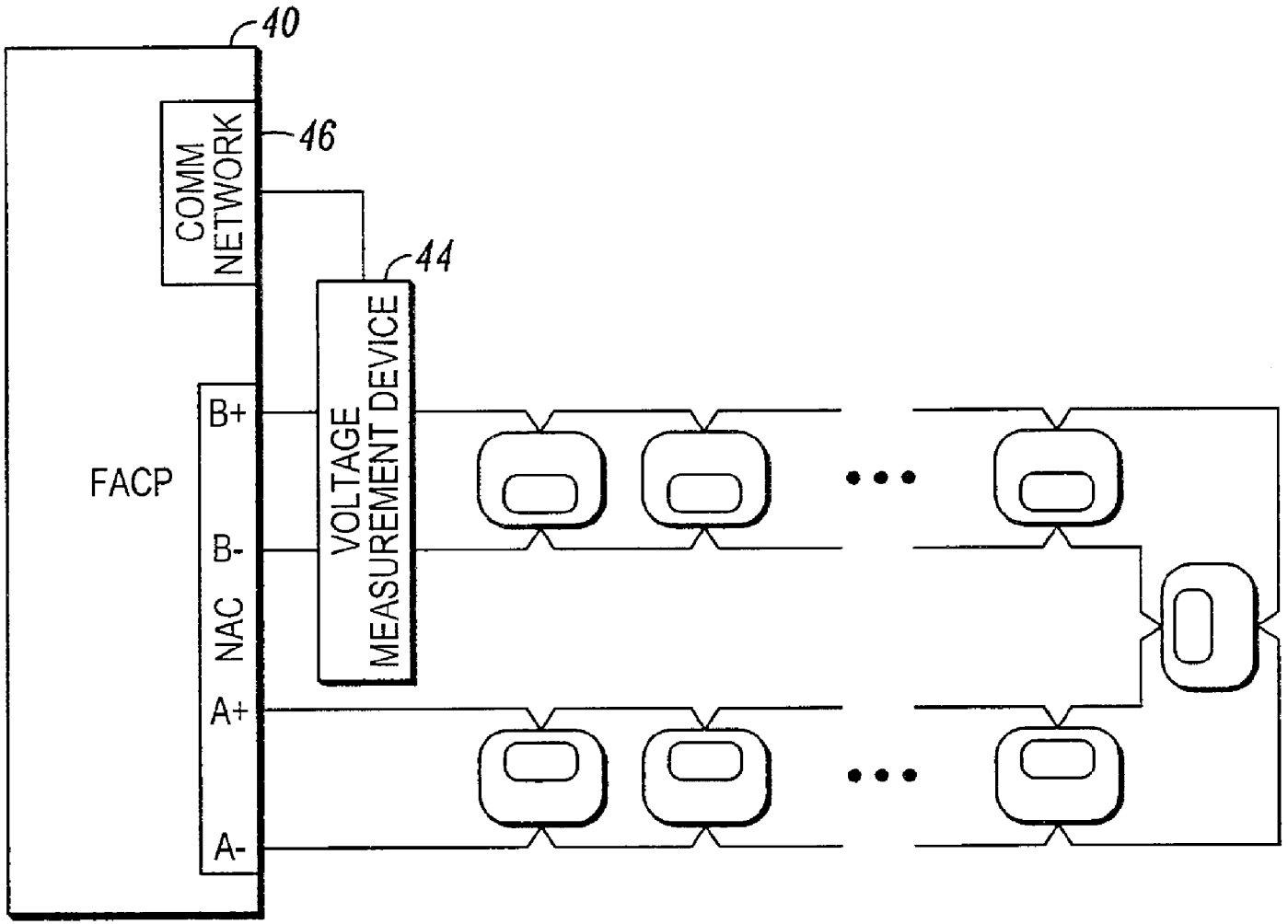
Figure 4C:
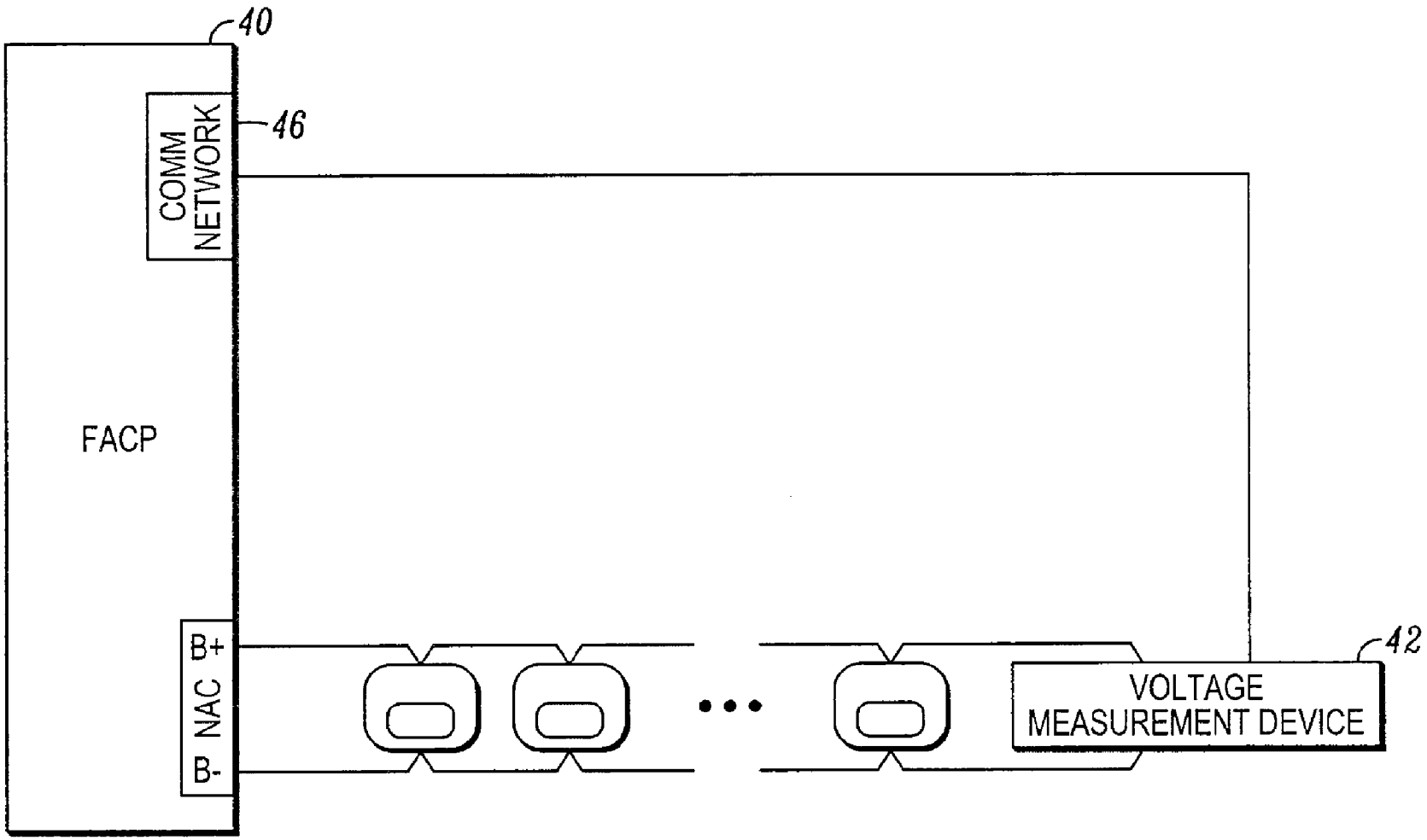

FIGS. 4A-C depict different configurations using different classes of wiring of the fire alarm control panel, NACs 5, and the NAC voltage measurement device 7. For example, FIG. 4A depicts a fire alarm control panel 40 working in combination with a voltage measurement device 42 wired for class B operation where the control of the voltage measurement device 42 is multiplexed with the NAC 5. As another example, FIG. 4B depicts a fire alarm control panel 40 working in combination with another type of voltage measurement device 44 in which class A wiring is used where the control of the voltage measurement device 44 is via communications with a comm network 46. Class A wiring requires additional functionality because the voltage measurement device (or another device such as the NAC controller) may break the line in order to perform the test. FIG. 4B shows the measurement device located at the B terminals on the NAC but this may not always be the required measurement location. The measurement location for Class A wiring will depend on the specific present in the building where the Fire Alarm System is installed. As still another example, FIG. 4C depicts a fire alarm control panel 40 working in combination with a voltage measurement device 42 using class B wiring where the control of the voltage measurement device 42 is via communications with a comm network 46.

Figure 5:
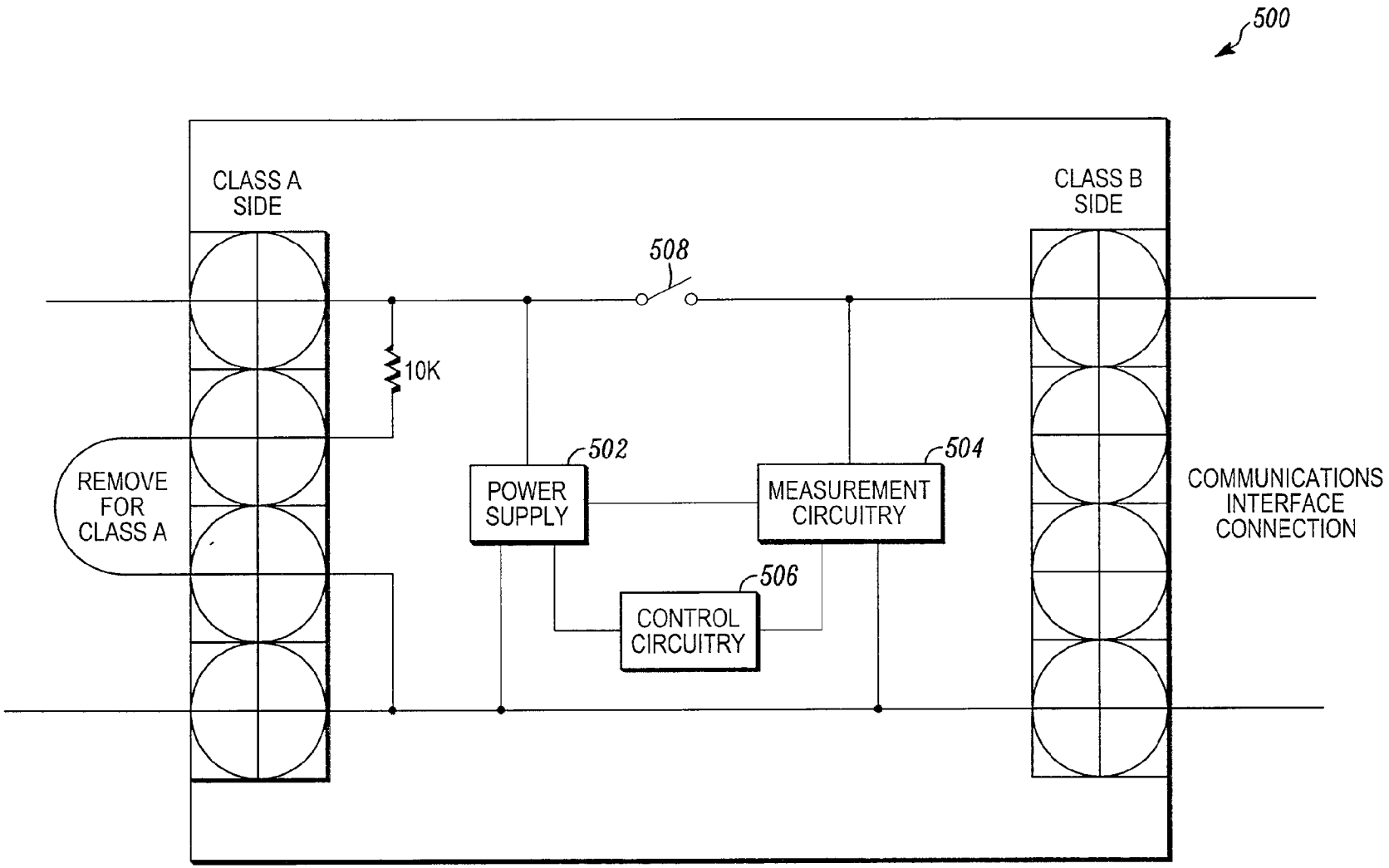
FIG. 5 depicts one example of NAC voltage measurement device.

FIG. 5 depicts one example of NAC voltage measurement device 7. As shown in FIG. 5, Collective NAC voltage measurement device 500 may be used for multiple types of wiring, such as both class A and class B wiring. Switch 508 may be closed or open, depending on whether class A or class B wiring is used. As shown in FIG. 5, the class B wiring may include a Communications Interface Connection so that it may interface with a variety of protocols. Similar to NAC voltage measurement device 7, Collective NAC voltage measurement device 500 may include a power supply 502, measurement circuitry 504 (which may measure any electrical aspect of the NAC 5, such as voltage), and control circuitry 506 (such as a processor and a memory). Using Collective NAC voltage measurement device 500, a single device may be used for NAC voltage measurement device 7 even though different configurations (such as different classes of wiring) are used for NAC 5.

Figure 6:
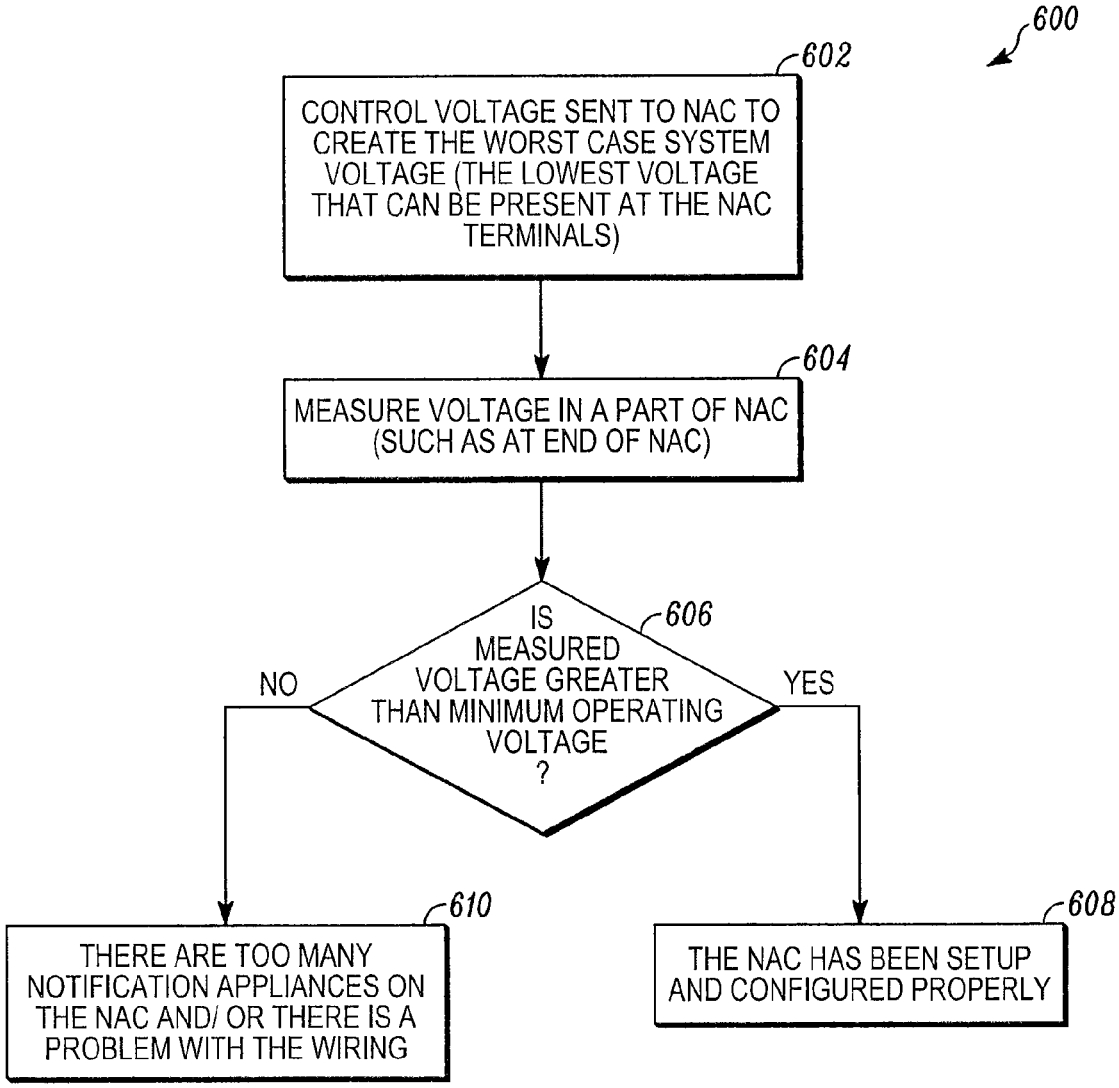
FIG. 6 is a flowchart for determining whether a NAC has sufficient voltage to power notification appliances when the Fire Alarm is operating at the lowest voltage that can power the system.

FIG. 6 is one example of a flow chart 600 for determining whether a NAC 5 has sufficient voltage when the panel is operating under low voltage conditions (such as nearly depleted battery operation) to operate one or more notification appliances 6 in the NAC 5. As shown at block 602, the voltage sent to the NAC 5 is controlled in order to create a worst case system voltage (such as the lowest voltage that can be present at the NAC terminals 3 and 4). As discussed above, a value (such as 19.5 V) for the voltage sent to the NAC 5 may be stored in a memory, such as memory 8. In response to a command, the NAC output controller 10 may control the voltage at terminals 3 and 4 to the predetermined voltage (such as 19.5 V) in order to simulate operation using battery power over an extended period of time without having to run down the battery or simulate a faulty AC power line. The example of 19.5 V is made for illustrative purposes only. Other voltages may be used. For example, the value of 32 V may likewise be used to simulate the upper bound of operating the NAC 5.

The voltage may be measured on a part of the NAC (such as at the end of the NAC 5), as shown at block 604. As discussed above, the NAC voltage measurement device 7 may measure the voltage and may then communicate the measured voltage to the control panel 15. The measured voltage may then be compared with a predetermined voltage (such as a minimum operating voltage) to determine whether the measured voltage is greater than the predetermined voltage, as shown at block 606. Alternatively, instead of being performed by the system controller 2, the voltage comparison may be performed by the NAC voltage measurement device 7 and/or the NAC controller 30.

Whether the measured voltage is greater or less than the predetermined voltage may determine whether the NAC 5 may operate or may not operate sufficiently at the worst case operating voltage (such as nearly depleted batteries or with a faulty AC power line). In particular, if the measured voltage is greater than the predetermined minimum operating voltage, it is determined that the NAC 5 has been setup and configured properly and may operate satisfactorily when operated at the worst case operating voltage, as shown at block 608. Conversely, if the measured voltage is less than the predetermined minimum operating voltage, it is determined that there are too many notification appliances on the NAC 5 and/or there is a problem with the wiring, as shown at block 610. Specifically, a part of the NAC 5 (such as one or more notification appliances 6) may potentially fail when the panel is operated at a supply voltage that is equal to or less than nominal. For example, if the minimum operating voltage for a NAC appliance 6 is 16 V and the measured voltage is 17 V, then it is determined that the measured voltage is greater and that the NAC 5 may operate satisfactorily using battery power.

Alternatively, instead of modifying the voltage at NAC output terminals 3 and 4 using control panel 15 (via the NAC Controller 30), a device separate from the control panel 15 may be used. For example, the wiring to output terminals 3 and 4 may be disconnected from the control panel 15 for the test and connected to a separate diagnostic device, such as a handheld diagnostic tool that powers the NAC 5 and simulates power to the NAC 5 at low voltage. The handheld diagnostic tool may include a separate power supply (or access to a separate power supply) to provide the power to simulate the low voltage. The NAC voltage measurement device 7 may still be used to measure the voltage at the end of the line.

The test sequence may be as follows: (1) disconnect NAC wiring from the control panel (such as disconnect wiring at output terminals 3 and 4); (2) connect NAC wiring to handheld diagnostic tool; (3) run the test software on the diagnostic tool (including reducing the voltage to the NAC); and (4) analyzing the signal from the NAC voltage measurement device 7 to determined whether the system passes or fails (the analysis, including the comparison of the voltage measured by the NAC voltage measurement device 7 with a predetermined voltage, may be performed at the NAC voltage measurement device 7; alternatively, the measured voltage may be transmitted to the handheld diagnostic tool for the handheld diagnostic tool to perform the comparison).

While the invention has been described with reference to various embodiments, it should be understood that many changes and modifications can be made without departing from the scope of the invention. It is therefore intended that the foregoing detailed description be regarded as illustrative rather than limiting, and that it be understood that it is the following claims, including all equivalents, that are intended to define the spirit and scope of this invention.

The invention claimed is:

1. A fire alarm control panel for controlling one or more notification appliances on a notification appliance circuit (NAC), the NAC being operational when supplied with a nominal voltage, the fire alarm control panel comprising:

a NAC interface;

an input interface separate from the NAC interface;

a memory configured to store a value indicative of a reduced voltage, the reduced voltage being less than or equal to the nominal voltage; and at least one controller in communication with the memory and being configured to:

supply the NAC with the reduced voltage via the NAC interface;

receive input via the input interface from at least one sensor, the at least one sensor being separate from the fire alarm control panel, the input indicative of at least one electrical parameter of the NAC when the NAC is supplied with the reduced voltage; and determine, based on the input, whether each of the notification appliances in the NAC is operable when supplied with the reduced power.

2. The fire alarm control panel of claim 1, wherein the input interface comprises a wired input interface configured to receive the input via at least one wire.

3. The fire alarm control panel of claim 1, wherein the fire alarm control panel is configured to receive input indicative of the NAC to operate in a test mode;

wherein the controller is configured to enter the test mode in response to a user interface receiving input indicative of the NAC to operate in the test mode; and wherein the controller is configured to, after determining whether the NAC has sufficient voltage to operate when supplied with the reduced voltage, operate the NAC in an operational mode.

4. The fire alarm control panel of claim 1, wherein the reduced voltage simulates a voltage supplied by at least one battery that is operating at an end of the battery's rated life.

5. The fire alarm control panel of claim 1, wherein the input is indicative of sensing voltage at an end-of-line for the NAC; and wherein the controller is configured to determine whether the NAC has sufficient voltage to operate when provided with the reduced voltage by comparing the indication of the sensed voltage with a predetermined voltage, the predetermined voltage stored in a memory of the fire alarm control panel.

6. The fire alarm control panel of claim 5, wherein the NAC comprises a plurality of notification appliances; and wherein the predetermined voltage comprises a minimum operating voltage for at least one of the plurality of notification appliances.

7. The fire alarm control panel of claim 5, wherein if the indication of the sensed voltage is greater than the predetermined voltage, the controller is configured to determine that the NAC has sufficient voltage to operate when the reduced voltage is provided to the NAC; and wherein if the indication of the sensed voltage is less than the predetermined voltage, the controller is configured to determine that the NAC has insufficient voltage to operate at least a part of the NAC when the reduced voltage is provided to the NAC.

8. The fire alarm control panel of claim 1, wherein the NAC comprises a plurality of notification appliances in a series; and wherein the input received from the at senses voltage at an end of the series of the plurality of notification appliances.

9. The fire alarm control panel of claim 1, wherein the NAC interface includes a plurality of terminals electrically connected to the NAC.

10. A method for controlling one or more notification appliances on a notification appliance circuit (NAC), the NAC being operational when supplied with a nominal voltage, the method comprising:

accessing a value indicative of a reduced voltage, the reduced voltage being less than or equal to the nominal voltage; and supplying the NAC with the reduced voltage via a NAC interface;

receiving input via an input interface from at least one sensor, the input interface being separate from the NAC interface, the input indicative of at least one electrical parameter of the notification appliance circuit when the notification appliance circuit is supplied with the reduced voltage; and determining, based on the input, whether each of the notification appliances in the notification appliance circuit is operable when supplied with the reduced power.

11. The method of claim 10, wherein receiving the input is via a wired input interface configured to receive the input.

12. The method of claim 10, further comprising:

receive an input command, via a fire alarm control panel, the input command indicative of the NAC to operate in a test mode;

entering, by the fire alarm control panel, the test mode in response to receiving the command input; and after determining whether the NAC has sufficient voltage to operate when supplied with the reduced voltage, operating the NAC in an operational mode.

13. The method of claim 10, wherein the reduced voltage simulates a voltage supplied by at least one battery that is operating at an end of the battery's rated life.

14. The method of claim 10, wherein the input is indicative of sensing voltage at an end-of-line for the NAC; and wherein determining whether the NAC has sufficient voltage to operate when provided with the reduced voltage comprises comparing the indication of the sensed voltage with a predetermined voltage, the predetermined voltage stored in a memory of a fire alarm control panel.

15. The method of claim 14, wherein the NAC comprises a plurality of notification appliances; and wherein the predetermined voltage comprises a minimum operating voltage for at least one of the plurality of notification appliances.

16. The method of claim 14, wherein if the indication of the sensed voltage is greater than the predetermined voltage, determining that the NAC has sufficient voltage to operate when the reduced voltage is provided to the NAC; and wherein if the indication of the sensed voltage is less than the predetermined voltage, determining that the NAC has insufficient voltage to operate at least a part of the NAC when the reduced voltage is provided to the NAC.

17. The method of claim 10, wherein the NAC comprises a plurality of notification appliances in a series.

18. The method of claim 10, wherein the NAC interface includes a plurality of terminals electrically connected to the NAC.

* * * * *